United States Patent [19]

Rosenberg et al.

[11] 4,293,247

[45] Oct. 6, 1981

[54] SEALS FOR MINE ROOF SUPPORTS

[75] Inventors: Harry Rosenberg, Lüdinghausen; Norbert Hölken, Lünen, both of Fed. Rep. of Germany

[73] Assignee: Gewerkschaft Eisenhutte Westfalia, Lünen, Fed. Rep. of Germany

[21] Appl. No.: 98,187

[22] Filed: Nov. 28, 1979

[30] Foreign Application Priority Data

Dec. 8, 1978 [DE] Fed. Rep. of Germany ..... 2853050

[51] Int. Cl.[3] ..... E21D 15/44

[52] U.S. Cl. ..... 405/296; 405/295

[58] Field of Search ..... 405/191-302; 299/31, 33; 403/166, 108; 91/170 MP

[56] References Cited

U.S. PATENT DOCUMENTS

| | | | |
|---|---|---|---|
| 1,923,123 | 8/1933 | Stahlecker | 403/166 X |
| 3,090,600 | 5/1963 | Smith | 403/166 X |
| 3,739,586 | 6/1973 | Wehner et al. | 405/296 |
| 3,837,170 | 9/1974 | Martinko et al. | 405/295 |
| 3,911,686 | 10/1975 | Becker et al. | 405/296 |

FOREIGN PATENT DOCUMENTS

| | | | |
|---|---|---|---|
| 466336 | 7/1975 | U.S.S.R. | 405/296 |

*Primary Examiner*—Dennis L. Taylor

*Attorney, Agent, or Firm*—Thompson, Birch, Gauthier & Samuels

[57] ABSTRACT

A mine roof support has a roof-engaging frame structure supported by hydraulic props on a floor frame and pivotably linked to a goaf shield. The roof frame and goaf shield have L-shaped seal plates at their sides. The seal plates are subjected to a lateral-outwardly-biasing spring force by means of springs and push rods accommodated in guide bores in both the roof frame and goaf shield. To adjust the distance between the plates, there are piston and cylinder units and coupling rods likewise accommodated in guide bores in both the roof frame and goaf shield. The seal plates of the roof frame overlap with those of the goaf shield. The plates are reduced in thickness at their overlapping regions and are pivotably interconnected thereat to correspond to the pivotal connection between the roof frame and the goaf shield. To facilitate assembly in situ, detachable push-in pins are located in bores in the coupling rods and push rods and in lower transverse walls of both the roof frame and goaf-shield. The pins fix the seal plates in a set position with clearance between the overlapping regions of the plates.

23 Claims, 5 Drawing Figures

SEALS FOR MINE ROOF SUPPORTS

BACKGROUND TO THE INVENTION

The present invention relates in general to mine roof supports and, more particularly, to lateral gap seals therefor.

It is known to employ seals for sealing off the gaps between adjacent roof supports in an underground mine working. These seals normally take the form of plates on the roof-engaging girders or structure and on the goaf-shields where provided. The plates on adjacent supports engage one another between the supports. Such an arrangement, although primarily intended for gap sealing, also tends to align and guide the supports on one another during shifting. It is known to employ piston and cylinder units for displacing the plates to adjust the plates and ensure good sealing and guiding contact. It is also known to employ springs which act to bias the plates apart so they can maintain contact even if the piston and cylinder units should fail during operation. An example of a known support employing lateral seals is described in German Pat. No. 2,310,757.

Hitherto, it has proved difficult to assemble the structural components of a roof support having lateral seals on its roof frame and goaf shield in situ primarily because the seal plates slidably and pivotably overlap between the roof frame and the goaf shield. Special accessories have thus been adopted to hold the plates of the roof frame or goaf shield in against the spring biasing force until the roof frame and goaf shield have been assembled together. This solution has not been wholly satisfactory, however.

A general object of the present invention is to provide an improved support and improved gap sealing means therefor.

SUMMARY OF THE INVENTION

A mine roof support constructed in accordance with the invention includes a roof-engageable frame structure, a goaf shield pivotably connected to the frame structure, gap sealing means composed of plates displaceably arranged at the sides of the frame structure and the goaf shield, the plates at the sides of the frame structure overlapping the plates at the respective associated side of the goaf shield in the zone of pivotable connection between the frame structure and the goaf shield, piston and cylinder units for effecting relative adjustable displacement between the plates at the opposite sides of the frame structure and goaf shield, spring means for urging the plates at the opposite sides of the frame structure and goaf shield apart and detachable locking elements for fixing the plates in a set position. The plates may be L-shaped with side flanges and transverse portions slidably engaging on transverse walls of the roof frame structure and the goaf shield. The plates are preferably reduced, say to half thickness at their overlapping regions, and are pivotably connected thereat. The locking elements, which may take the form of simple push-in pegs or pins, can serve, inter alia, to space the plates apart in their overlapping regions to create clearances for facilitating assembly. Thus, the locking elements, easily inserted during pre-assembly, can hold the plates of the roof frame and the goaf shield until these latter structural components have been properly assembled in situ. By transporting the roof frame and the goaf shield with the seal plates already locked in position, no special measures need to be adopted to ensure the plates locate with one another without hinderance during assembly in the mine working. Thereafter, some of the locking elements can be removed to render the seal plates fully operative.

The piston and cylinder units and the spring means are preferably each accommodated within guide bores inside the roof frame and the goaf shield. The piston and cylinder units can be interposed with coupling rods in their guides while the spring means may be interposed in an analogous fashion with push rods in their guides. The coupling rods and push rods may wall be identical, or at least similar, and at least some of the locking elements may connect with the coupling and push rods.

The piston and cylinder units may each have its cylinder biased to an associated coupling rod while its piston rod connects with a head piece, preferably detachably secured by one of the locking elements to the roof frame structure or the goaf shield as the case may be. Screws or the like may then serve to fix the head piece detachably to the adjacent seal plates.

Bores for receiving push-in pins constituting the locking elements can be provided in inner transverse walls of both the roof frame structure and the goaf shield and in the push and coupling rods and in the head pieces. When all the respective bores are aligned to receive the pins the desired clearance mentioned above is established. Various possible dimensional relationships to achieve this end are discussed in detail hereinafter. In one possible construction, the distances between the centres of the bores in the movable components of the piston and cylinder units and in the push rods of the spring means and the adjacent inner faces of the outermost portions of some of the plates which internally overlap with the outermost portion of the adjacent associated plates is less than the distance between the centres of the bores in the movable components of the piston and cylinder units and in the push rods of the spring means and the adjacent inner faces of the outermost portions of the adjacent associated plates. It is, however, possible to adopt the converse arrangement.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
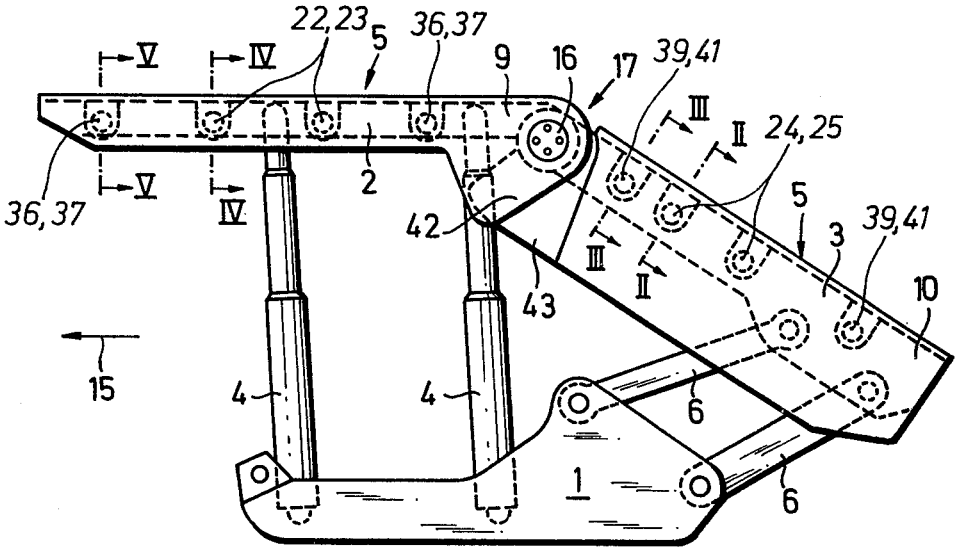
FIG. 1 is a schematic side view of a single mine roof-support provided with gap sealing means constructed in accordance with the invention.

As shown in FIG. 1, a roof support intended for use primarily in a longwall mineral mine working employs a floor-engaging structure or base frame 1 and a roof-engaging structure or roof frame 2. Hydraulic props 4, preferably articulated to the frames 1,2, extend therebetween and can be raised to brace the support between the roof and floor of the mine working or relieved to permit the unit to be shifted. A goaf shield 3 is pivotably connected as at 17 to the rear of the roof frame 2 relative to the mineral face and levers or links 6 articulate the base frame 1 to the goaf shield 3. The levers 6 form the known "lemnisate" guide system which so guides the pivotal motion of the components that the roof frame 2 maintains its disposition during retraction and extension of the props 4. The support, or more particularly, the roof frame 2 and the goaf shield 3, is provided with adjustable gap sealing means constructed in accordance with the invention and generally designated by reference numeral 5. This gap sealing means 5 co-operates with similar means provides on adjacent supports along the working to seal the gaps between the adjacent supports and additionally guides and aligns the supports during shifting as is known per se.

As shown in FIGS. 1 to 5, the sealing means 5 comprises L-shaped angle seal plates 7,8,9,10 arranged at the lateral sides of the roof frame 2 and the goaf shield 3. The left-hand side plates, 7,8 of FIGS. 2 to 5 engage with one of their wall portions on the upper and outermost transverse walls of the rod frame 2 and the goaf shield 3, while their other wall portions 11,12 project over the left-hand sides of the roof frame 2 and the goaf shield 3. Likewise, the right-hand side plates 9,10 of FIGS. 2 to 5 engage with one of their wall portions on the upper and outermost transverse walls of the roof frame 2 and the goaf shield 3, while their other wall portions 13,14 project over the right-hand sides of the roof frame 2 and the goaf shield 3. The outer side wall portions or flanges 11,12,13,14 of the plates, 7,8,9,10 which are substantially upstanding, are stepped or reduced to a dimension 'D' equal to half their full thickness 'D'over adjoining regions which slidably overlap one another so that the flanges 11,12 and 13,14 present continuous smooth outer surfaces aligned in the winning direction (arrow 15, FIG. 1). The plates 7,8 and 9,10 are respectively articulated to one another at their overlapping regions by pivot joints 16 to correspond to the articulation axis 17 (FIG. 1) between the roof frame 2 and the goaf shield 3. The pivot joints 16 can take the form of cylindrical flanges.

Figure 2:
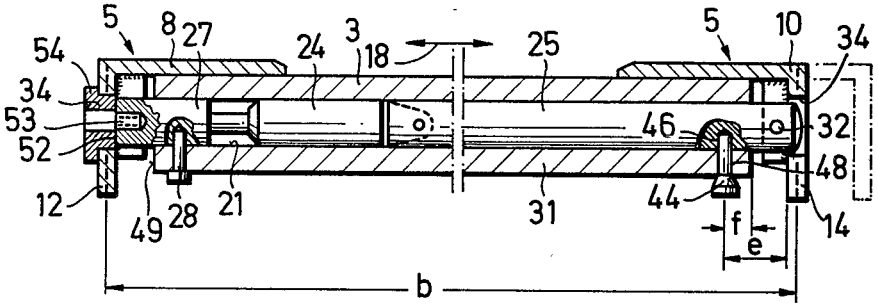
FIG. 2 is a sectional view of part of the support and its sealing means, the view being taken along the line II—II of FIG. 1.
Figure 5:
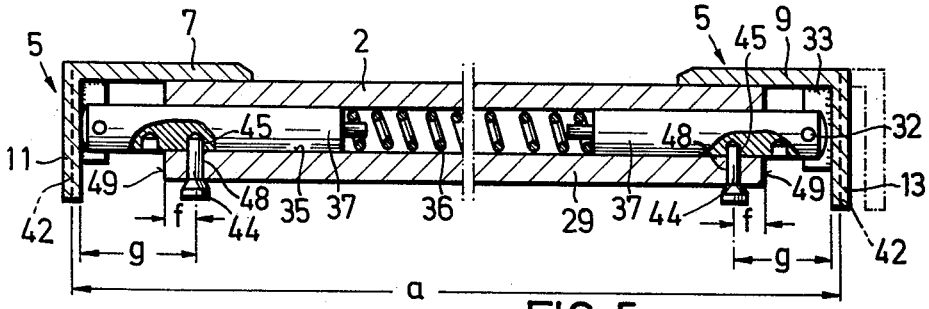
FIG. 5 is a sectional view of part of the support and its sealing means, the view being taken along the line V—V of FIG. 1.

The seal plates 9,10 disposed at the left-hand side of the support relative to the mineral face can be positionally adjusted (arrows 18, FIG. 2) laterally of the support, after removal of initially-installed locking elements as described hereinafter, sliding over the upper and outermost faces of the roof frame 2 and the goaf shield 3. FIGS. 2 and 5 depict one possible alternative position for the plates 9,10 in chain-dotted outline. In order to adjust the plates 9,10, devices composed of hydraulic piston and cylinder units 22,24 and coupling rods 23,25 are provided. The piston and cylinder unit 22 and its associated coupling rod 23 are arranged in a bore 19 in the roof frame 2, while the piston and cylinder unit 24 and its associated coupling rod 25 are arranged in a bore 21 in the goaf shield 3. The bores 19,21 extend across the support in the adjustment direction—arrows 18, FIG. 2. The rods 25,23 are slidably guided in the respective bores 21,19, have a diameter matching that of the cylinders of the respective units 24,22 and are articulated to the cylinders of the units 24,22 respectively. The piston rods of the units 24,22 are provided with head pieces 27,26 which also locate in the bores 21,19. Detachable locking elements in the form of fixing bolts, pins 28 or the like extend through lower walls or chords 31,29 of the goaf shield 3, and the roof frame 2 to engage with, and lock, the head pieces 27,26 to the goaf shield 3 and the roof frame 2. The outer ends of the rods 23,25 are articulated to th flanges 13,14 of the seal plates 9,10 respectively. For this purpose, pivot pins 32 engage in borings in the rods 23,25 and are supported by webs or strips 33 welded to the inner faces of the plates 9,10 in their corner regions. To permit the adjustment devices 24,25 and 22,23 to be removed or dismantled for maintenance, the side flanges 11,12,13,14 of all the plates 7 to 10 are provided with access holes 34 aligned with the bores 19,21.

Figure 3:
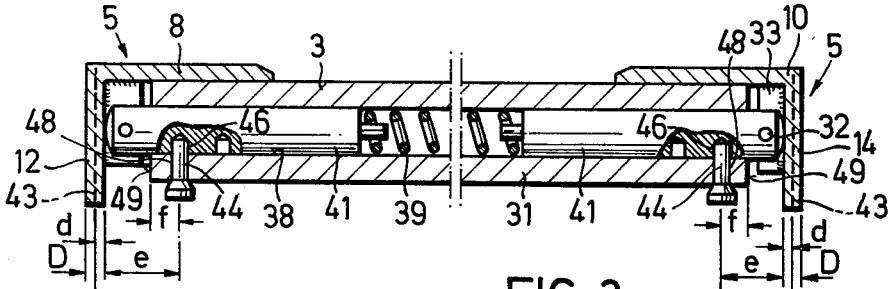
FIG. 3 is a sectional view of part of the support and its sealing means, the view being taken along the line III—III of FIG. 1.
Figure 4:
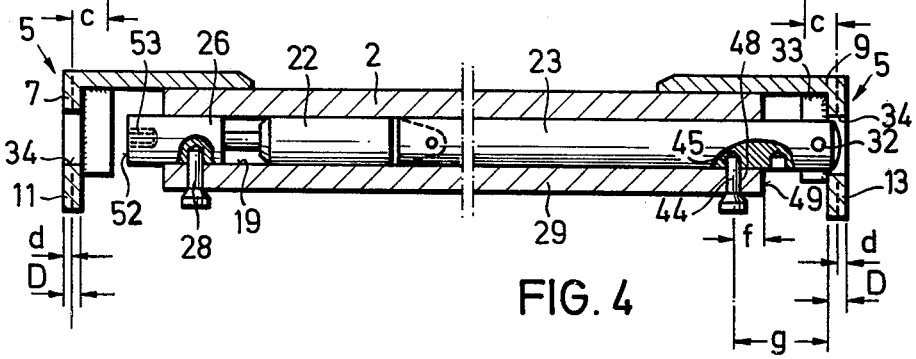
FIG. 4 is a sectional view of part of the support and its sealing means, the view being taken along the line IV—IV of FIG. 1.

The seal plates 7 to 10 are maintained under a certain lateral resilient outwardly-biasing force by means of compression springs 36,39 shown in FIGS. 3 and 5. These springs 36,39 locate in bores 35,38 in the roof frame 2 and the goaf shield 3. These bores 35,38 extend across the support parallel to the bores 19,21. The springs 36,39 engage on the end of push rods 37,41 slidably guided in the bores 35,38. The outer ends of the push rods 37,41 are articulated to the respective plates 7 to 10 in a similar manner to the coupling rods 23,25 with the aid of pins 32 supported by webs or strips 33 welded inside the plates 7 to 10. The push rods 37,41 and the coupling rods 23,25 may be identical for ease of replacement and manufacture.

To facilitate installation in the mine working, where conditions are often cramped, the roof frame 2 and the goaf shield 3, which are heavy units, are best transported individually and preassembled with the sealing means 5, constructed as described, in situ. In the preassembled condition, the seal plates 7,9 of the roof shield 2 are arranged and maintained with the distance 'a' (FIG. 5) between the outer-reduced regions 42 of their flanges 11,13 somewhat greater than the corresponding distance 'b' (FIG. 2) between the outer reduced regions 43 of the flanges 12,14 of the seal plates 8,10 of the goaf shield 3 that they are intended to overlap with. In this way, when the roof frame 2 is being fitted to the goaf shield 3, there is a clearance gap 'c' (FIG. 3) which ensures the seal plates 7 to 10 will not hinder the making of the articulated connection between the goaf shield 3 and the roof frame 2. The preassembled seal plates 7 to 10 are locked in the relationship $a>b$ by push-in locking elements 44 inserted through bores 48 in the lower chords or walls 29,31 of the roof frame 2 and the goaf shield 3 to engage in bores 45,46 in the push-rods 37,41 and in the coupling rods 23,25. The distance 'g' between the centres of the bores 45 in the push rods 37 and the inside of the flanges 11,13 of the seal plates 7,9 and between the centre of the bore 45 in the coupling rod 23 and the inside of the flange 13 of the seal plate 9 on the roof frame 2 is greater than the distance 'e' between the centres of the bores 46 in the push rods 41 and the inside of the flanges 12,14 of the seal plates 8,10 and between the centre of the bore 46 in the coupling rod 25 and the inside of the flange 14 of the seal plate 10 of the goaf shield 3. The distance 'f' between the centre of the bores 48 in the walls 29,31 of the roof frame 2 and the goaf shield 3 and the side faces 49 of these walls 29,36 is made the same. It is, however, possible to adopt the contrary arrangement with the distances 'g,e' made the same while the distance 'f' between the centre of the bores 48 and the side face 49 of the wall 29 is correspondingly greater than the distance 'f' between the centres of the bores 48 and the side face 49 of the wall 31. Without the provision of the locking elements 44 the forces of the springs 36,39 would tend to urge the plates 8 and 10 and 7 and 9 apart. With the relationship a>b preserved, however, the assembly of the roof frame 2 to the goaf shield 3 opposite to the winning direction 15 and the making of the pivot joint 17 can proceed unimpeded. With all the locking elements 44 inserted to fix the plates 7 to 10 in the manner described, it is possible for the inside edges of the strips 33 to abut the side faces 49 of the frame 2 and the goaf shield 3.

The head pieces 26,27 of the piston rods of the units 22,24 have threaded holes 53 in their outer end faces 52. Cover plates 54 can be optionally inserted into the access holes 54 in the flanges 11,12 of the plates 7,8 and fixed by screws located in the holes 53, as shown in FIG. 2. If desired, during assembly or operation, the plates 54 can be fitted to fix the head piece 26 or 27 to the flange 11 or 12. Then after removal of the locking element 28 from the head piece 36 or 27 and the locking elements 44 from the associated push rods 37,38 the unit 22 or 24 can be operated to urge the seal plate 7 or 8 inwardly against the force of the spring 36 or 37. Normally, however, the seal plates 7,8 are fixed with the elements 28,44 after assembly and only the seal plates 9,10 are rendered adjustable by removing the locking elements 44 pertaining thereto. These adjustable plates 9,10 would be brought into engagement with corresponding fixed plates 7,8 of one adjacent roof support while the fixed plates 7,8 would be engaged by adjustable plates 9,10 of the other adjacent roof support.

We claim:

1. A mine roof support which includes a roof-engageable frame structure, a goaf shield pivotably connected to the frame structure, gap sealing means composed of plates displaceably arranged at the sides of the frame structure and the goaf shield, the plates at the sides of the frame structure overlapping the plates at the respective associated side of the goaf shield in the zone of pivotable connection between the frame structure and the goaf shield, piston and cylinder units for effecting relative adjustable displacement between the plates at the opposite sides of the frame structure and goaf shield, spring means for urging the plates at the opposite sides of the frame structure and goaf shield apart and detachable locking elements for fixing the plates in a set position.

2. A support according to claim 1, wherein said locking elements at least serve to space the plates apart on their overlapping regions to create clearances for facilitating assembly.

3. A support according to claim 1, wherein said piston and cylinder units are accommodated within the frame structure and the goaf shield and are interposed with coupling rods between the plates at the opposite sides of the frame structure and the goaf shield.

4. A support according to claim 3, wherein the piston and cylinder units and the coupling rods are located and guided in bores in the frame structure and the goaf shield.

5. A support according to claim 4, wherein the coupling rods are each pivotably connected to an associated one of the plates and to an associated one of the piston and cylinder units.

6. A support according to claim 5, wherein the coupling rods are pivotably connected to the cylinders of the units and the piston rods of the units are connected with head pieces, detachably fixed with locking elements to the frame structure and goaf shield.

7. A support according to claim 6, wherein means is provided for detachably fixing the head pieces to the adjacent plates at one side of the frame structure and goaf shield.

8. A support according to claim 3, wherein at least some of the detachable locking elements are engageable between the frame structure and goaf shield and the coupling rods.

9. A support according to claim 1, wherein the spring means are accommodated within the frame structure and the goaf shield and are interposed between push rods acting on the plates of the opposite sides of the frame structure and the goaf shield.

10. A support according to claim 9, wherein the push rods are pivotably connected to the plates at the opposite sides of the frame structure and the goaf shield.

11. A support according to claim 9, wherein the push rods and spring means are located and guided in bores in the frame structure and the goaf shield.

12. A support according to claim 9, wherein at least some of the detachable locking elements are engageable between the frame structure and goaf shield and the push rods.

13. A support according to claim 1, wherein guide means is provided for guiding the displaceable components of the piston and cylinder units in the frame structure and the goaf shield.

14. A support according to claim 1, wherein the spring means acts on the plates via intermediate push rods and guide means are provided for guiding the push rods in the frame structure and the goaf shield.

15. A support according to claim 1, wherein the plates are L-shaped with flanges extending over the sides of the frame structure and the goaf shield and further portions slidably engaging on outer transverse surfaces of the frame structure and the goaf shield.

16. A support according to claim 1, wherein the locking elements take the form of push-in pins engageable in aligned bores.

17. A support according to claim 16, wherein some of the bores are provided in transverse walls of the frame structure and the goaf shield and at least some of the remainder of the bores are provided in the displaceable components of the piston and cylinder units and in push-rods associated with the spring means.

18. A support according to claim 11, wherein the distance between the centres of the bores in the transverse walls of the frame structure and of the goaf shield and the adjacent sides of the frame structure and the goaf shield is the same and wherein the distance between the centres of the bores in the movable components of the piston and cylinder units and in the push rods of the spring means and the adjacent inner faces of the outermost portions of some of the plates which internally overlap with the outermost portion of the adjacent associated plates is less than the distance between the centres of the bores in the movable components of the piston and cylinder units and in the push rods of the spring means and the adjacent inner faces of the outermost portions of the adjacent associated plates.

19. A support according to claim 17, wherein the bores are arranged so that the engagement of all the locking elements ensures there is clearance between the overlapping plates.

20. A support according to claim 3, wherein the spring means are accommodated within the frame structure and the goaf shield and are interposed between push rods acting on the plates of the opposite sides of the frame structure and the goaf shield and wherein closable apertures are provided in the plates to permit access to the piston and cylinder units and the spring means with their associated coupling and push rods.

21. A support according to claim 1, wherein the plates are pivotably interconnected at each side of the frame structure and the goaf shield in the zone where the plates overlap.

22. A support according to claim 1, wherein the plates have reduced end portions at the overlapping regions.

23. A support according to claim 6, wherein the spring means are accommodated within the frame structure and the goaf shield and are interposed between push rods acting on the plates of the opposite sides of the frame structure and the goaf shield and wherein the locking elements are push-in pins located in bores in transverse walls of the frame structure and goaf shield which align with respective bores in the push rods, the coupling rods and the head pieces.

* * * * *

UNITED STATES PATENT AND TRADEMARK OFFICE

CERTIFICATE OF CORRECTION

PATENT NO. : 4,293,247

DATED : Oct. 6, 1981

INVENTOR(S) : Harry Rosenberg and Norbert Holken

It is certified that error appears in the above-identified patent and that said Letters Patent are hereby corrected as shown below:

Col. 1, line 22, change "2,310,757" to --2,210,757--.

Signed and Sealed this

*Twenty-third* Day of *February 1982*

[SEAL]

*Attest:*

GERALD J. MOSSINGHOFF

*Attesting Officer*

*Commissioner of Patents and Trademarks*